US008151885B2

(12) United States Patent
Bull et al.

(10) Patent No.: US 8,151,885 B2
(45) Date of Patent: Apr. 10, 2012

(54) EROSION RESISTANT FLOW CONNECTOR

(75) Inventors: Brad R. Bull, Duncan, OK (US); Ivan L. Blanco, Duncan, OK (US); Kenneth G. Neal, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 283 days.

(21) Appl. No.: 12/426,696

(22) Filed: Apr. 20, 2009

(65) Prior Publication Data

US 2010/0263872 A1 Oct. 21, 2010

(51) Int. Cl.
*E21B 43/29* (2006.01)
*F16L 41/02* (2006.01)

(52) U.S. Cl. ..... 166/305.1; 166/90.1; 166/75.15; 137/561 A

(58) Field of Classification Search ..... 166/305.1, 166/77.51, 117, 344, 90.1, 75.15; 239/590.5, 239/440; 285/120.1, 122.1, 123.1, 125.1, 285/285.1; 137/561 A
See application file for complete search history.

(56) References Cited

U.S. PATENT DOCUMENTS 657,372 A * 9/1900 Wiggins ..... 285/285.1
936,839 A * 10/1909 Wardwell ..... 285/285.1
1,572,471 A * 2/1926 Doolittle ..... 137/265
1,582,529 A * 4/1926 Mueller ..... 285/18
2,663,325 A * 12/1953 Bede ..... 285/122.1
3,640,308 A * 2/1972 Bydal ..... 137/561 A
4,070,044 A * 1/1978 Carrow ..... 285/133.11
4,076,282 A * 2/1978 Scott et al. ..... 285/133.3
4,310,288 A 1/1982 Erickson
4,463,460 A * 8/1984 Arnold et al. ..... 4/678
4,593,716 A * 6/1986 Cesna ..... 137/561 A
4,801,160 A * 1/1989 Barrington ..... 285/81
5,005,650 A * 4/1991 Hopper ..... 166/339
5,170,942 A * 12/1992 Spink et al. ..... 239/427.3
5,330,007 A * 7/1994 Collins et al. ..... 166/313
5,474,235 A * 12/1995 Cole et al. ..... 239/431
5,660,589 A * 8/1997 Smith ..... 464/14
5,794,642 A * 8/1998 Zikeli et al. ..... 137/4
5,863,188 A * 1/1999 Dosman ..... 417/391
6,035,953 A * 3/2000 Rear ..... 175/171
6,056,059 A * 5/2000 Ohmer ..... 166/313
6,247,532 B1 * 6/2001 Ohmer ..... 166/50
6,254,014 B1 * 7/2001 Clearman et al. ..... 239/222.15
6,413,004 B1 * 7/2002 Lin ..... 403/176
6,443,247 B1 * 9/2002 Wardley ..... 175/402
6,557,628 B2 * 5/2003 Ohmer ..... 166/50
6,702,045 B1 * 3/2004 Elsby ..... 175/93
6,848,637 B2 * 2/2005 Holtsnider ..... 239/587.1
6,851,450 B2 * 2/2005 Nimberger ..... 137/561 A
6,986,499 B2 * 1/2006 Davis et al. ..... 251/58
7,073,976 B1 * 7/2006 Webb ..... 405/52
7,096,982 B2 * 8/2006 McKay et al. ..... 175/412
7,168,448 B2 * 1/2007 Schmidt ..... 137/561 A
7,185,717 B2 * 3/2007 Holte et al. ..... 175/57

(Continued)

*Primary Examiner* — Kenneth L Thompson
(74) *Attorney, Agent, or Firm* — John W. Wustenberg; Conley Rose, P.C.

(57) ABSTRACT

A wellbore servicing apparatus, comprising an inlet space, a central space adjacent and in fluid communication with the inlet space along a central axis, a dome space adjacent and in fluid communication with the central space along the central axis, and a plurality of channels adjacent to and in fluid communication with the dome space, wherein the plurality of channels are radially spaced about the central axis, and wherein a channel axis of the at least one of the plurality of channels is incident the central axis by less than ninety degrees.

20 Claims, 12 Drawing Sheets

U.S. PATENT DOCUMENTS

| | | | | |
|---|---|---|---|---|
| 7,290,626 | B2 * | 11/2007 | Terlet et al. | 175/296 |
| 7,445,247 | B2 * | 11/2008 | Ericksen et al. | 285/39 |
| 7,467,674 | B2 * | 12/2008 | Green | 175/296 |
| 7,581,561 | B2 * | 9/2009 | Funamara et al. | 137/625.47 |
| 7,581,602 | B2 * | 9/2009 | Lorger et al. | 175/296 |
| 7,584,767 | B2 * | 9/2009 | Funamura et al. | 137/625.47 |
| 7,600,711 | B1 * | 10/2009 | Nyhus | 244/7 A |
| 7,740,288 | B2 * | 6/2010 | Mantell | 285/332.1 |
| 7,775,234 | B2 * | 8/2010 | Campisi | 137/269 |
| 7,775,285 | B2 * | 8/2010 | Surjaatmadja et al. | 166/374 |
| 7,886,842 | B2 * | 2/2011 | Howard et al. | 175/4.51 |
| 2002/0050260 | A1 * | 5/2002 | Harvey | 123/184.21 |
| 2004/0206504 | A1 * | 10/2004 | Rosato | 166/298 |
| 2007/0125541 | A1 | 6/2007 | Bull et al. | |
| 2007/0201305 | A1 * | 8/2007 | Heilman et al. | 366/141 |
| 2008/0116688 | A1 | 5/2008 | Bull et al. | |
| 2008/0169644 | A1 * | 7/2008 | Kim | 285/120.1 |
| 2009/0120635 | A1 * | 5/2009 | Neal | 166/250.15 |
| 2009/0178720 | A1 * | 7/2009 | Torres | 137/561 A |
| 2009/0194273 | A1 * | 8/2009 | Surjaatmadja et al. | 166/250.1 |
| 2010/0032031 | A1 * | 2/2010 | Neal | 137/565.01 |
| 2010/0096474 | A1 * | 4/2010 | Zhang et al. | 239/265.17 |
| 2010/0155066 | A1 * | 6/2010 | Fordyce | 166/280.1 |
| 2010/0219268 | A1 * | 9/2010 | Wurz | 239/590.5 |
| 2010/0307773 | A1 * | 12/2010 | Tinnen et al. | 166/387 |
| 2010/0318021 | A1 * | 12/2010 | Mantell | 604/26 |
| 2010/0326648 | A1 * | 12/2010 | McGuire | 166/90.1 |

* cited by examiner

EROSION RESISTANT FLOW CONNECTOR

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In wellbore servicing operations, such as fracturing operations, high pressure fracturing fluids may be pumped down the well to cut a casing and penetrate and/or fracture hydrocarbon formations. Fluids are pressurized using high pressure pumps and are fed to a wellbore services manifold trailer. This wellbore services manifold trailer is often used for receiving, organizing, and distributing wellbore servicing fluids during wellbore servicing operations. Typically, a wellbore services manifold trailer has manifold outlets sized at about 7 inches in diameter with a pressure rating of about 10,000 psi and a flow rate capacity of about 100 barrels per minute. From the wellbore services manifold trailer, the high pressure fluids are typically split into a plurality of flows using a connector that accommodates a plurality of wellhead manifold inlet lines. Each of the plurality of flows is then fed into a wellhead of the wellbore being serviced.

Generally, the high pressure fracturing fluids are particle laden fluids that are pumped at sufficient velocity, for example jetted or hydrojetted, to cut a casing and penetrate the hydrocarbon formations. However, connectors used in fracturing operations may have a short life expectancy of only up to about two weeks because of erosion caused by the particle laden fluids. Thus, a need exists for an improved connector for use in wellbore servicing operations that is resistant to erosion and has a longer life expectancy.

SUMMARY

Disclosed herein is a wellbore servicing apparatus, comprising an inlet space, a central space adjacent and in fluid communication with the inlet space along a central axis, a dome space adjacent and in fluid communication with the central space along the central axis, and a plurality of channels adjacent to and in fluid communication with the dome space, wherein the plurality of channels are radially spaced about the central axis, and wherein a channel axis of the at least one of the plurality of channels is incident the central axis by less than ninety degrees.

Also disclosed herein is a method of servicing a wellbore, comprising providing a wellbore servicing fluid, pumping the wellbore servicing fluid to a wellbore services manifold trailer, transferring at least some of the wellbore servicing fluid from the wellbore services manifold trailer into a central space of a flow connector through an inlet space of the flow connector, transferring at least some of the wellbore servicing fluid from the central space of the flow connector into at least one channel of the flow connector, where the at least one channel has a central axis that is incident a central axis of the inlet space by less than ninety degrees.

In an embodiment, a method of extending a life expectancy of a flow connector used in a wellbore servicing operation comprises providing an inlet space, providing central space adjacent and in fluid communication with the inlet space along a central axis, providing a dome space adjacent and in fluid communication with the central space along the central axis, and providing a plurality of channels adjacent to and in fluid communication with the dome space. The plurality of channels are radially spaced about the central axis and at least one of the plurality of channels has a channel axis that is incident the central axis by less than ninety degrees.

In another embodiment, the method further comprises transferring a wellbore servicing fluid through the inlet space, transferring the wellbore servicing fluid through the channel, and transferring the wellbore servicing fluid into a wellbore.

In another embodiment, the wellbore servicing fluid is a particle laden fluid.

In another embodiment, the wellbore servicing fluid is configured to erode an object located within the wellbore.

In another embodiment, the wellbores servicing fluid is configured to erode a portion of a hydrocarbon formation.

In another embodiment, the method further comprises transferring the wellbore servicing fluid from the channel through a reducer prior to transferring the wellbore serving fluid into the wellbore.

In another embodiment, the plurality of channels are substantially evenly spaced about the central axis.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENT(S)

Figure 1:
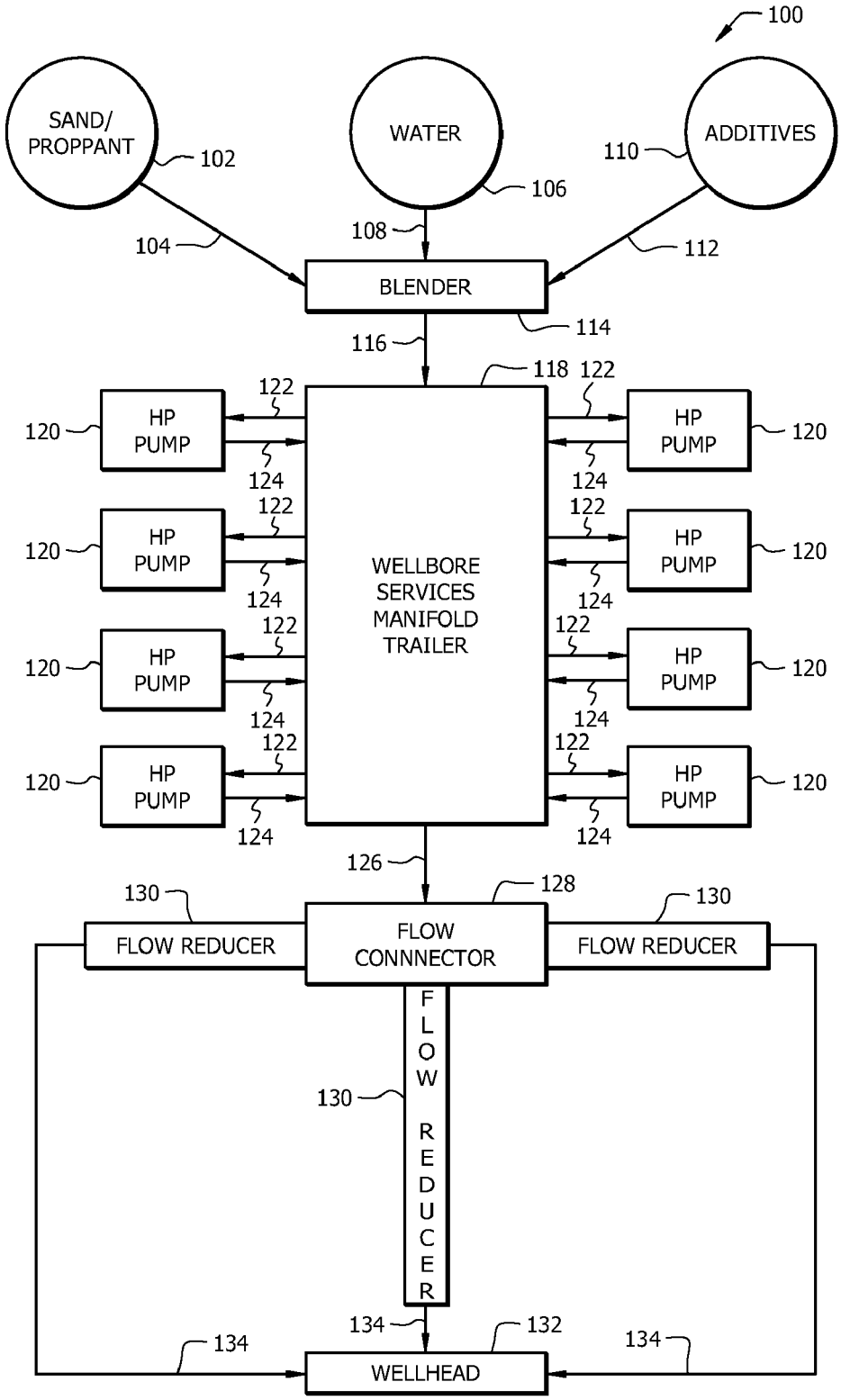
FIG. 1 is a simplified flow diagram of one embodiment of a flow connector and three flow reducers in a wellbore servicing operation.

In the drawings and description that follow, like parts are typically marked throughout the specification and drawings with the same reference numerals, respectively. The drawing figures are not necessarily to scale. Certain features of the disclosure may be shown exaggerated in scale or in somewhat schematic form and some details of conventional elements may not be shown in the interest of clarity and conciseness.

Referring to FIG. 1, a wellbore servicing system 100 is shown as comprising an embodiment of a flow connector 128. The wellbore servicing system 100 is a system for fracturing wells in low-permeability reservoirs. In fracturing operations, wellbore servicing fluids, such as particle laden fluids, are pumped at high-pressure into a wellbore. The particle laden fluids are then introduced into a portion of a subterranean formation at a sufficient pressure and velocity to cut a casing and create perforation tunnels and fractures within the subterranean formation. Proppants, such as grains of sand, are mixed with the wellbore servicing fluid to keep the fractures open so that hydrocarbons may be produced from the subterranean formation and flow into the wellbore. Hydraulic fracturing creates high-conductivity fluid communication between the wellbore and the subterranean formation.

Referring to FIG. 1, the wellbore servicing system 100 comprises a blender 114 that is coupled to a wellbore services manifold trailer 118 via flowline 116. As used herein, the term "wellbore services manifold trailer" includes a truck and/or trailer comprising one or more manifolds for receiving, organizing, and/or distributing wellbore servicing fluids during wellbore servicing operations. In this embodiment, the wellbore services manifold trailer 118 is coupled to eight high pressure (HP) pumps 120 via outlet flowlines 122 and inlet flowlines 124. In alternative embodiments, however, there may be more or fewer HP pumps used in a wellbore servicing operation. Outlet flowlines 122 are outlet lines from the wellbore services manifold trailer 118 that supply fluid to the HP pumps 120. Inlet flowlines 124 are inlet lines from the HP pumps 120 that supply fluid to the wellbore services manifold trailer 118. The wellbore services manifold trailer 118 is further coupled to the flow connector 128 via flowline 126. The wellbore services manifold trailer 118 generally has manifold outlets sized at about 7 inches in diameter with Big Inch® style interfaces and a pressure rating of about 10,000 psi. It will be appreciated that Big Inch® style interfaces comprise a clamp-type union having two hubs clamped together with a seal therebetween, as exemplified by the commercially available so-called Grayloc® union or Big Inch® connections employed by Halliburton Company of Duncan, Okla. Thus, flowline 126 has an inner diameter of about 7 inches to accommodate the flow from the outlets of the wellbore services manifold trailer 118.

The flow connector 128 is coupled to three flow reducers 130. The three flow reducers 130 are coupled to the wellhead 132 via flowlines 134. The wellhead 132 generally has manifold outlets sized at about 4 inches in diameter with pressure ratings of about 10,000 psi. In this embodiment, each flowline 134 is substantially equal in size. In alternative embodiments, however, each flowline 134 may be differently sized or one or more flowlines 134 may be reduced or closed off. Nevertheless, the combined flow rate from flowlines 134 is still equal to the flow rate of flowline 126.

The blender 114 mixes solid and fluid components to achieve a well-blended wellbore servicing fluid. As depicted, sand or proppant 102, water 106, and additives 110 are fed into the blender 114 via feedlines 104, 108, and 112, respectively. The water 106 may be potable, non-potable, untreated, or treated water. In this embodiment, the blender 114 is an Advanced Dry Polymer (ADP) blender and the additives 110 are dry blended and dry fed into the blender 114. In alternative embodiments, however, additives may be pre-blended with water using a GEL PRO blender, which is a commercially available preblender trailer from Halliburton Energy Services, Inc., to form a liquid gel concentrate that may be fed into the blender. The mixing conditions of the blender 114, including time period, agitation method, pressure, and temperature of the blender 114, may be chosen by one of ordinary skill in the art with the aid of this disclosure to produce a homogeneous blend having a desirable composition, density, and viscosity. In alternative embodiments, however, sand or proppant, water, and additives may be premixed and/or stored in a storage tank before entering a wellbore services manifold trailer.

The HP pumps 120 pressurize the wellbore servicing fluid to a pressure suitable for delivery into the wellhead 132. For example, the HP pumps 120 may increase the pressure of the wellbore servicing fluid to a pressure of from about 30 psi to about 80 psi, alternatively from about 6,000 psi to about 20,000 psi, alternatively about 10,000 psi. The HP pumps may be any suitable high pressure pumps, such as positive displacement pumps.

From the HP pumps 120, the wellbore servicing fluid may reenter the wellbore services manifold trailer 118 via inlet flowlines 124 and be combined so that the wellbore servicing fluid may have a total fluid flow rate that exits from the wellbore services manifold trailer 118 through flowline 126 to the flow connector 128 of from about 1 BPM to about 200 BPM, alternatively from about 50 BPM to about 150 BPM, alternatively about 100 BPM.

Figure 2:
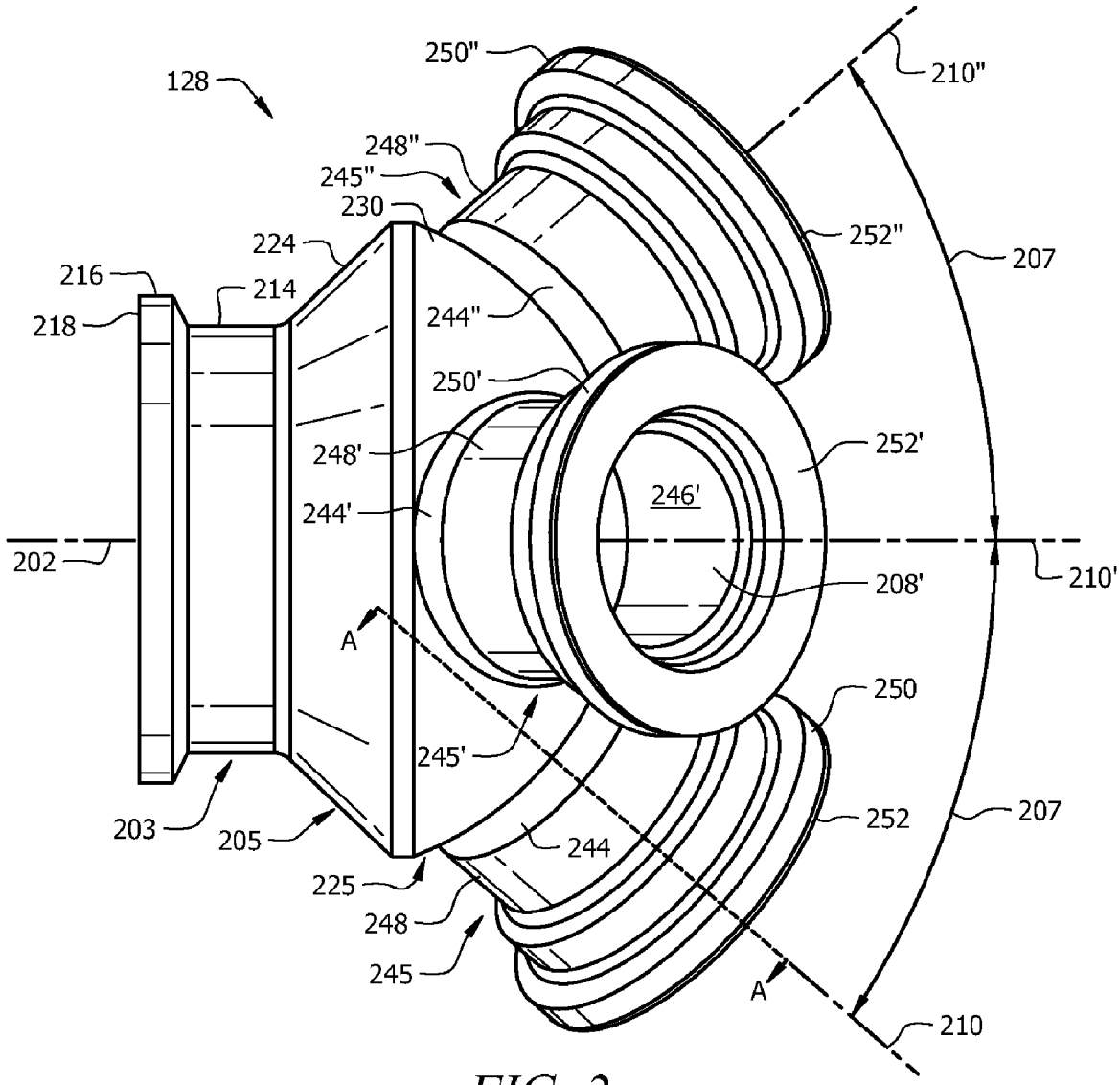
FIG. 2 is an orthogonal view of the flow connector of FIG. 1.

The wellbore services manifold trailer 118 is further coupled to the flow connector 128 via flowline 126. In this embodiment, the flowline 126 is about 7 inches in diameter with a Big Inch® style interface, a pressure rating of 10,000 psi, and a flow rate capacity of about 100 barrels per minute (also referred to as "BPM"). As shown in FIG. 2, the flow connector 128 has one inlet 203 sized at about 7 inches in diameter with a Big Inch® style interface and three outlets 245, 245', 245" sized at about 5 inches in diameter with a Big Inch® style interface. After leaving the wellbore services manifold trailer 118 via flowline 126, the wellbore servicing fluid enters the flow connector 128.

Figure 10:
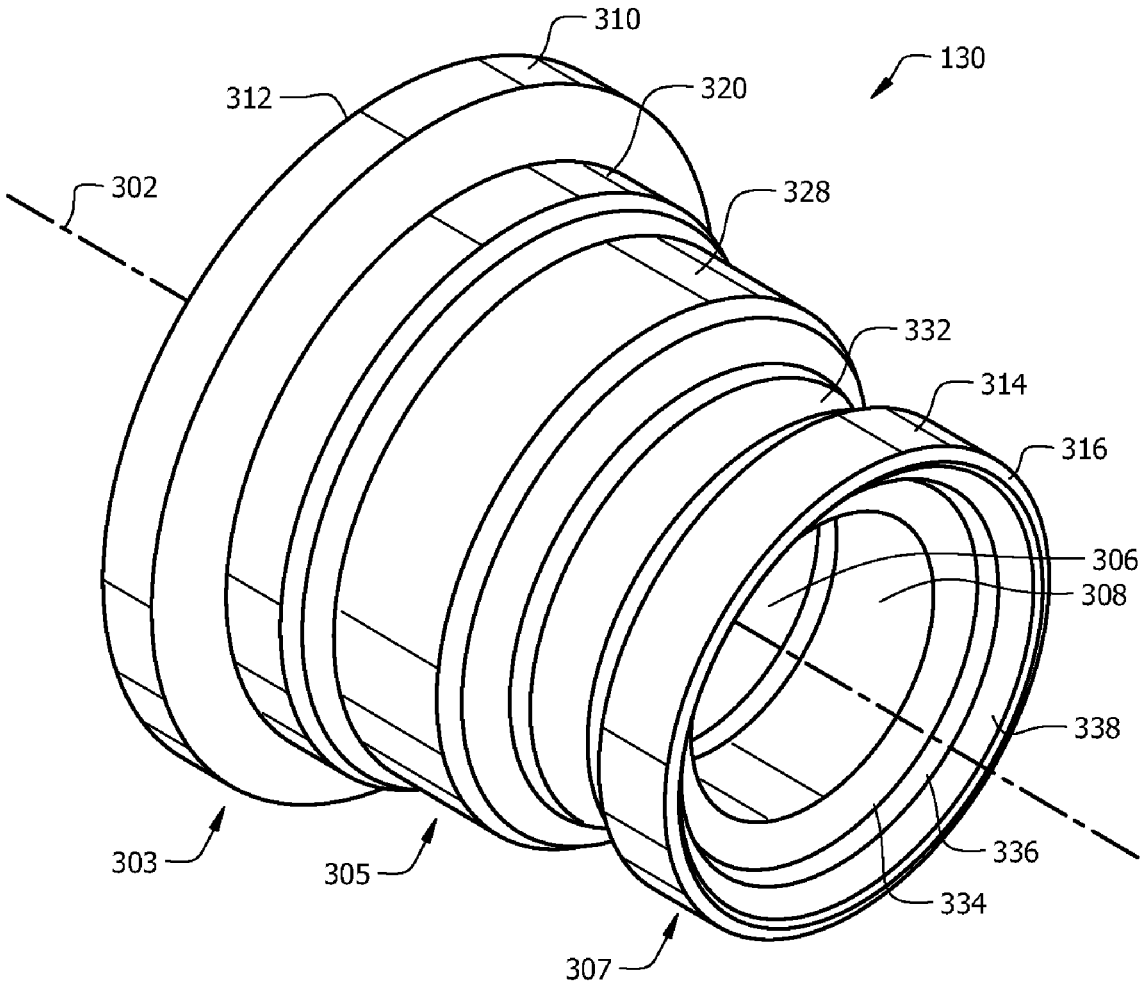
FIG. 10 is an oblique view of the flow reducer of FIG. 1.

The flow connector 128 is coupled to three flow reducers 130. As shown in FIG. 10, the flow reducers 130 each have an inlet 303 sized at about 5 inches in diameter with a Big Inch® style interface and an outlet 307 sized at about 4 inches in diameter with a hammer union style interface. From the flow reducers 130, the wellbore servicing fluid is directed to the wellhead 132 via flowlines 134. From the wellhead 132, the wellbore servicing fluid is sent downhole to service the wellbore.

Persons of ordinary skill in the art with the aid of this disclosure will appreciate that the flowlines described herein are piping that are connected together for example via flanges, collars, welds, etc. These flowlines may include various configurations of pipe tees, elbows, and the like. These flowlines connect together the various wellbore servicing fluid process equipment described herein.

Figure 15:
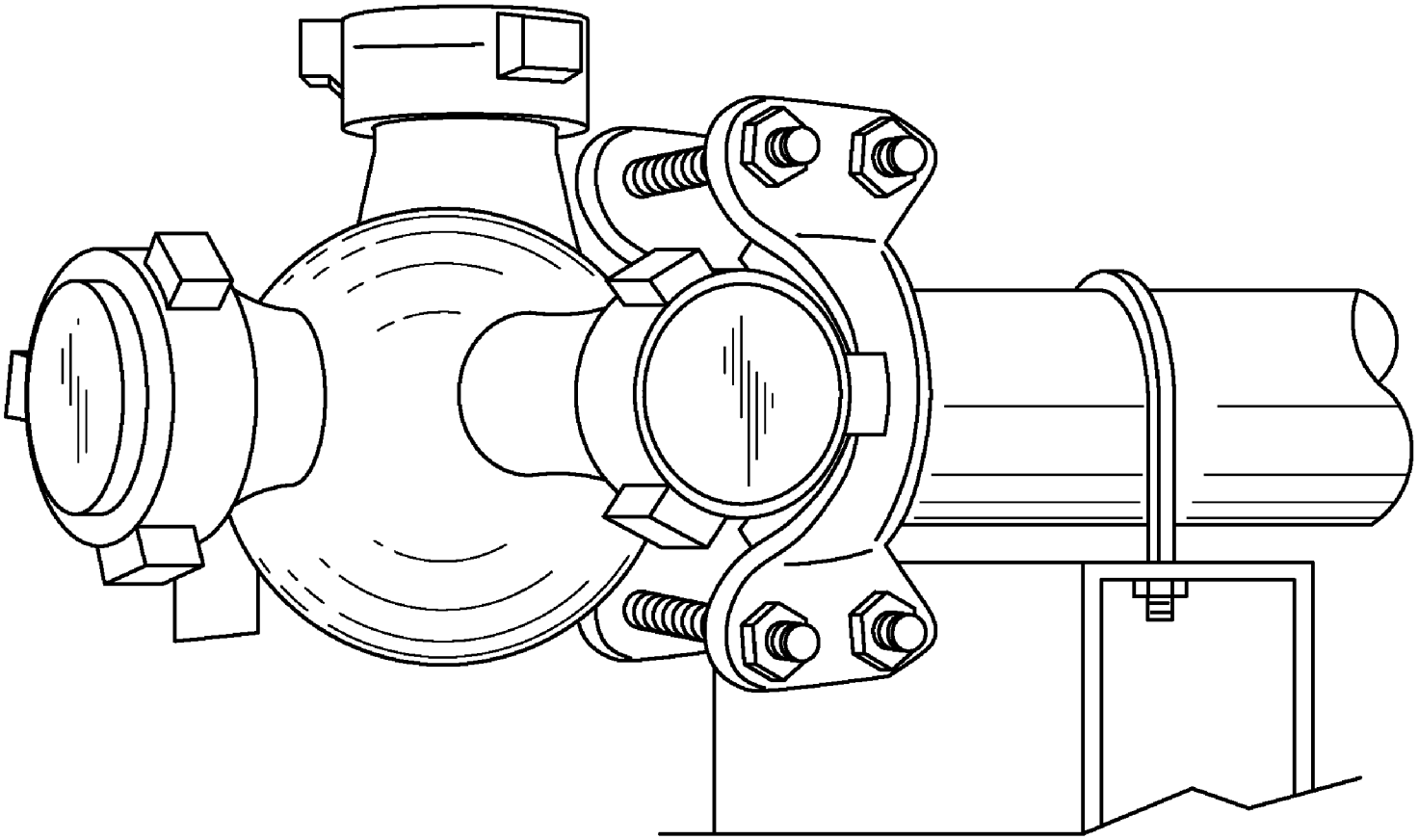
FIG. 15 (Prior Art)
FIG. 15 is a perspective view of a conventional flow connector.

One of the components of a wellbore servicing system that often experiences high wear is a connector having outlets that are oriented generally orthogonal to a central axis of an inlet of the connector. Hereinafter, a connector that has outlets orthogonal to its inlet and a body (sometimes substantially spherical in shape) that joins the inlet and the outlets is referred to as a conventional connector. A conventional connector having a substantially spherical body connected to one inlet and four orthogonal outlets is shown in FIG. 15. This conventional connector often fails inspection at or near welded junctions between the outlets and the body. However, the flow connector 128 of the wellbore servicing system 100 generally provides increased life expectancy over the conventional connector, as described infra.

Figure 3:
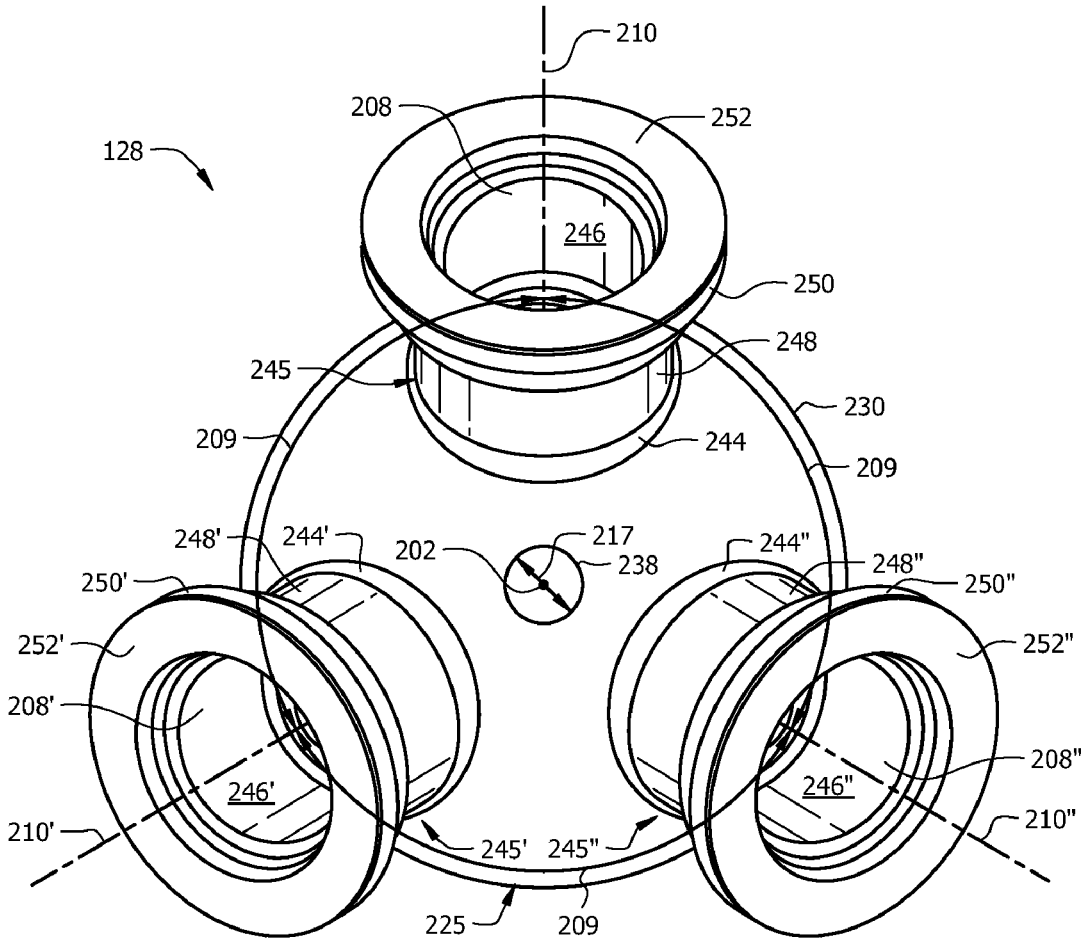
FIG. 3 is an orthogonal view of the flow connector of FIG. 1.
Figure 4:
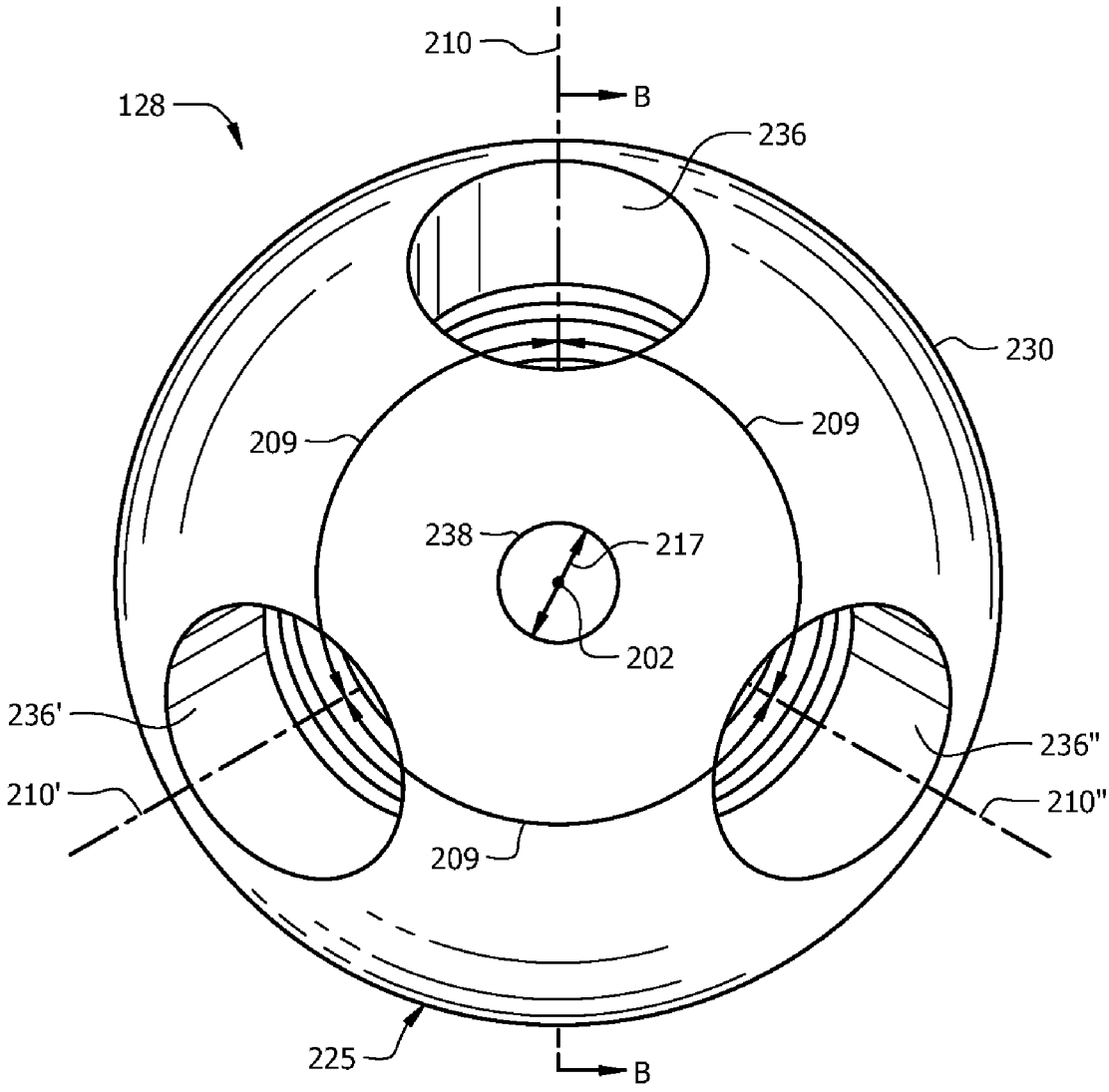
FIG. 4 is a partial orthogonal view of the flow connector of FIG. 1 with the flow connector outlets detached therefrom.
Figure 5:
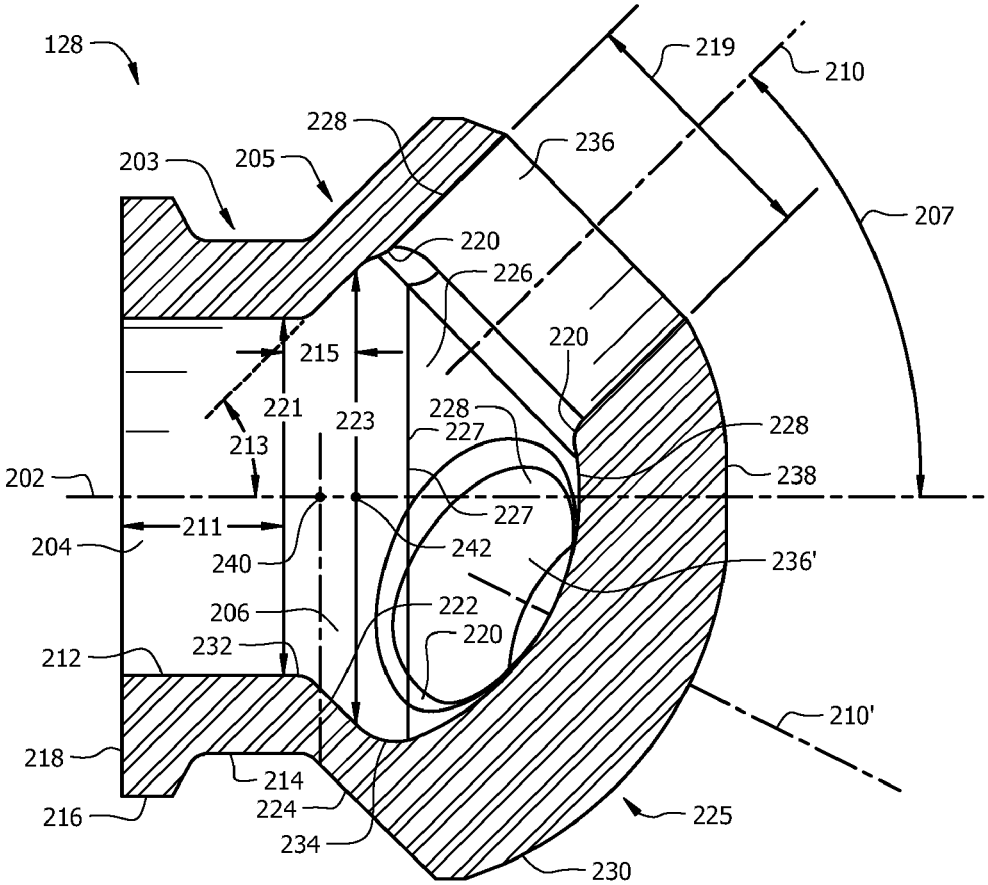
FIG. 5 is a partial cross-sectional view of the flow connector of FIG. 1 taken at line A-A of FIG. 2.
Figure 6:
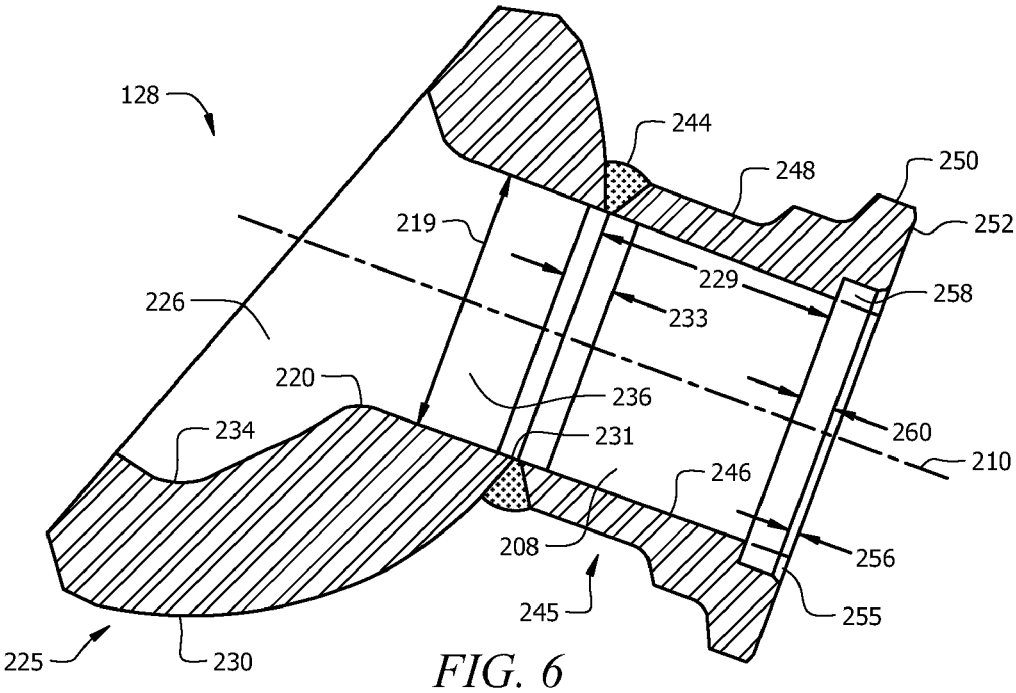
FIG. 6 is a partial cross-sectional view of the flow connector of FIG. 1 taken at line B-B of FIG. 4.

Referring now to FIGS. 2-7, an orthogonal view of the flow connector 128 of FIG. 1 is shown in greater detail. Generally, FIGS. 2-3 and 6-7 show a fully assembled flow connector 128, complete with flow connector outlets 245, 245', and/or 245". However, FIGS. 4-5 show an unassembled flow connector 128 without flow connector outlets 245, 245', and/or 245". An orthogonal view of the flow connector 128 showing the placement of the flow connector outlets 208, 208', and 208" is shown in FIG. 3. A partial orthogonal view of the flow connector 128 with the flow connector outlets 245, 245', and 245" detached therefrom is shown in FIG. 4. A partial cross-sectional view of the flow connector of FIG. 1 taken at line A-A of FIG. 2 is shown in FIG. 6. Another partial cross-sectional view of the flow connector of FIG. 1 taken at line B-B of FIG. 4 is shown in FIG. 5.

The flow connector 128 may be used in various wellbore servicing operations to split an incoming fluid flow having a flow into three outgoing fluid flows having a combined flow rate that equals the incoming fluid flow rate. An incoming fluid flow rate may be between about 1-200 barrels per minute or alternatively about 100 barrels per minute. For example, an incoming fluid flow rate of about 100 barrels per minute, each of the three outgoing fluid flows has a flow rate of about 33.3 barrels per minute. In an embodiment, one of the flow connector outlets (e.g., flow connector outlets 245, 245', or 245") may be closed off with a cap or a plug. In such an embodiment, the flow connector 128 may be used to split an incoming flow rate (for example, 66.6 barrels per minute) into two outgoing flow rates that has a combined flow rate equal to the incoming rate (e.g., 66.6 barrels per minute). In that embodiment, the two outgoing flow rates may be the same so that each has a flow rate of 33.3 barrels per minute. Alternatively, the two outgoing flow rates may be different. Nonetheless, the combined flow rate will equal the incoming flow rate (e.g., 66.6. barrels per minute). In yet another alternative embodiment, two of the flow connector outlet spaces (e.g., flow connector outlet spaces 208 and 208') may be closed off with caps or plugs resulting in a single outgoing flow rate equal to the incoming flow rate.

The flow connector 128 generally comprises a flow connector inlet space 204, a flow connector central body space 206, a flow connector dome body space 226, three channels 236, 236', and 236", and three flow connector outlet spaces 208, 208', and 208". In alternative embodiments, however, there may be different number of channels and a corresponding number of flow connector outlet spaces, such as 2, 4, 5, etc. The flow connector inlet space 204 is adjacent and in fluid communication with the flow connector central body space 206 along a flow connector central axis 202. The flow connector dome body space 226 is adjacent and in fluid communication with the flow connector central body space 206 along the flow connector central axis 202. The channels 236, 236', and 236" are adjacent and in fluid communication with the flow connector dome body space 226 and are evenly radially spaced about the flow connector central axis 202. The channels 236, 236', and 236" lie on channel axes 210, 210', and 210", respectively, and are incident to the flow connector central axis 202 and normal to the flow connector dome body space 226. The flow connector outlet spaces 208, 208', and 208" are adjacent and in fluid communication with the channels 236, 236', and 236", respectively. In that way, the flow connector outlet spaces 208, 208', and 208" are coaxially aligned with the channels 236, 236', and 236" along the channel axes 210, 210', and 210", respectively.

Referring now to FIGS. 2-6, the flow connector outlet space 208 lies along a channel axis 210, the flow connector outlet space 208' lies along a channel axis 210', and the flow connector outlet space 208" lies along a channel axis 210", and the axes 210, 210', and 210" are incident to and evenly radially spaced about the flow connector central axis 202. In this embodiment, the axes 210, 210', and 210" each have an angle of incidence 207 of 45° with the flow connector central axis 202. Of course, in alternative embodiments, the above-describe angle of incidence 207 may be more or less than 45°. For example, the angle of incidence 207 may alternatively be any other suitable value between nearly 90° and nearly 0°. More specifically, the angle of incidence 207 may alternatively be approximately 89°, 87°, 85°, 80°, 75°, 70°, 65°, 60°, 55°, 50°, 40°, 35°, 30°, 25°, 20°, 15°, 10°, 5°, 3°, or 1°. The axes 210, 210', and 210" are also radially separated from each other by flow connector separation angles 209 of 120° about the flow connector central axis 202. Further, in alternative embodiments, the flow connector separation angles 209 may not be substantially equal between all flow connector central axes 210, 210', and 210".

The flow connector inlet space 204 is defined by a flow connector inlet 203 having a flow connector inlet interior surface 212 and a flow connector inlet exterior surface 214. As depicted, the flow connector inlet interior surface 212 and the flow connector inlet exterior surface 214 are cylindrical in shape. The flow connector inlet 203 further comprises a flow connector inlet hub 216, which is annular in shape, and a flow connector inlet flat end face 218, which is perpendicular to the flow connector central axis 202. In this embodiment, the flow connector inlet space 204 has a diameter of about 7 inches and extends inward from flow connector flat end face 218 at length 211 of about 2 to about 3 inches, alternatively about 2 inches, alternatively about 2.9 inches, alternatively about 2.97 inches, or alternatively about 2.972 inches. The flow connector exterior surface 214 has a diameter of about 10 inches. The length of the flow connector inlet 203 along the flow connector central axis 202 is about 3-4 inches or alternatively about 3.5 inches. The flow connector inlet space 204 is adjacent and in fluid communication with the flow connector central body space 206, which is adjacent and in fluid communication with the flow connector dome body space 226. The central body space 206 generally extends from the flow connector inlet space 204 inward a distance 215 of about 0.5-1.5 inches, alternatively about 1 inch, alternatively about 1.3 inches, alternatively about 1.37 inches, or alternatively about 1.379 inches. The flow connector dome body space 226 generally extends from the central body space 206 and is generally bounded by the dome body interior surface 228. In this embodiment, the flow connector inlet 203 is configured to facilitate a Big Inch® clamp style union between the flow connector 128 and the flowline 126 that joins the flow connector 128 to the wellbore services manifold trailer 118 of FIG. 1.

The flow connector central body space 206 is defined by a central body 205 having a central body interior surface 222 and a central body exterior surface 224. The flow connector dome body space 226 is defined by a dome body 225 having a dome body interior surface 228, a dome body exterior surface 230, and the three channels 236, 236', and 236".

The central body interior surface 222 is generally frusto-conical in shape and has a tapered angle 213 of about 45° and two differently sized openings, a smaller opening having a first diameter 221 of about 7 inches adjacent the flow connector inlet interior surface 212 and a larger opening having a second diameter 223 of about 8 inches to about 9 inches, alternatively about 8 inches, alternatively about 8.9 inches, or alternatively about 8.93 inches, adjacent the dome body interior surface 228. The tapered angle 213 may alternatively be approximately 89°, 87°, 85°, 80°, 75°, 70°, 65°, 60°, 55°, 50°, 40°, 35°, 30°, 25°, 20°, 15°, 10°, 5°, 3°, or 1°. Further, in alternative embodiments, the tapered angle 213 may not be substantially the same value as the angle of incidence 207.

A convex joint 232 connects the central body 205 to the flow connector inlet 203 while a concave joint 234 connects the central body 205 to the flow connector to the dome body interior 225. Both the convex joint 232 and the concave joint 234 provide a smooth inner surface for the flow connector 128. In this embodiment, the convex joint 232 and the concave joint 234 have inner radii of curvatures of about 1 inch and about 0.75 inches, respectively. In alternative embodiments, however, inner radii of a convex joint and a concave joint may be greater or smaller while still providing a smooth inner surface for transitioning between a flow connector inlet, a flow connector central body, and a flow connector dome body. In this embodiment, the convex joint 232 extends longitudinally along the flow connector central axis 202 generally between about the location of first diameter 221 as shown in FIG. 5 to about the location of flow connector body spherical center 240. In this embodiment, the concave joint 234 extends longitudinally along the flow connector central axis 202 generally between about the second diameter 223 as shown in FIG. 5 to about a transition plane 227 which is shown as lying substantially orthogonal to central axis 202 in FIG. 5. The transition plane 227 is offset from the second diameter 223 by about 0.5 to about 1.5 inches, alternatively about 1 inch, or alternatively about 1.05 inches.

The dome body space 226 has a radius of about 5 inches from a spherical center 240 of the dome body space 226 that is located on the flow connector central axis 202 between the flow connector inlet space 204 and the dome body space 226. As depicted, the spherical center 240 is located on the flow connector central axis 202 and offset from a plane defined by the flow connector flat end face 218 by about 3-4 inches, alternatively about 3.8 inches, or alternatively about 3.81 inches.

The dome body exterior surface 230 has a radius of about 8 inches from the flow connector body spherical center 240. The thickness of the dome body 225 between the dome body interior surface 228 and the dome body exterior surface 230 is about 3 inches. The dome body exterior surface 230 further comprises a generally circular flat surface 238 normal to the connector central axis 202. The flat surface 238 is located on the flow connector central axis 202 and offset from a plane defined by the flow connector flat end face 218 by about 11-12 inches, alternatively about 11.6 inches, or alternatively about 11.63 inches. Flat surface 238 aids during manufacturing (i.e., machining) of the flow connector 128. For example, the flat surface 238 may be used by a machine to hold onto the flow connector 128 in a known orientation during formation of the dome body interior surface 228. In this embodiment, the flat surface 238 has a flat surface diameter 217 of about 1-3 inches or alternatively about 2 inches.

As discussed previously, the flow connector 128 further comprises three channels 236, 236', and 236". The flow connector 128 operates to separate a single incoming fluid flow that enters the flow connector 128 from the flow connector inlet space 204 into three separate fluid flows, one for each channel 236, 236', and 236". Each of the channels 236, 236', and 236" has a channel diameter 219 of about 5 inches near the dome body interior surface 228 and increases slightly to a diameter of about 5.1 inches or alternatively to about 5.12 inches near the dome body exterior surface 230. The slightly larger diameter near the dome body exterior surface 230 is configured to reduce erosion that may occur near that area. In alternative embodiments, the slightly larger diameter may be about 0.01-0.03%, alternatively about 0.02%, or alternatively about 0.024% larger than the channel diameter 219. In this embodiment, transition curves 220 join the channels 236, 236', and 236" to the dome body space 226. In this embodiment, the transition curves 220 generally comprise a typical radius of curvature of about 0.5-1.5 inches, alternatively about 0.7 inches, or alternatively about 0.75 inches so that a smooth transition is provided.

As depicted, the portion of the flow connector 128 that defines the flow connector inlet space 204, the flow connector central body space 206, the dome body space 226, and the channels 236, 236', and 236" is manufactured from a single piece of material as a unitary structure. That unitary structure has an unassembled flow connector center of gravity 242 located on the flow connector central axis 202 and offset from a plane defined by the flow connector inlet flat end face 218 by about 5-6 inches, alternatively about 5.9 inches, or alternatively about 5.93 inches.

The flow connector 128 further comprises the flow connector outlet spaces 208, 208', and 208" that lie along the channel axes 210, 210', and 210", respectively, incident to the flow connector central axis 202 and normal to the dome body space 226. The flow connector outlet spaces 208, 208', and 208" are defined by flow connector outlets 245, 245', and 245" having flow connector outlet interior surfaces 246, 246', and 246" that are cylindrical in shape, and flow connector outlet exterior surfaces 248, 248', and 248" that are also cylindrical in shape. The flow connector outlets 245, 245', and 245" are further defined by annular flow connector outlet hubs 250, 250', and 250", and flow connector outlet flat end faces 252, 252', and 252" that are perpendicular to the axes 210, 210', and 210", respectively. The flow connector outlet collars 250, 250', and 250" and the flow connector outlet flat end faces 252, 252', and 252" are configured to match the Big Inch® clamp style interface typically employed on the wellbore services manifold trailer 118 of FIG. 1. However, in alternative embodiments, a flow connector may have at least one outlet configured in any suitable style interface, for example a threaded interface.

In this embodiment, the outlet space length 229 of each flow connector outlet space 208, 208', and 208" along the channel axes 210, 210', and 210", respectively, is about 5-6 inches or alternatively about 5.5 inches. Also in this embodiment, a frusto-conical mouth space 255 extends inward from the outlet flat end face 252 by a distance 256 of about 0.2 inches, or alternatively about 0.25 inches. A cylindrical recess space 258 abuts the frusto-conical mouth space 255 and has a diameter of about 5-6 inches, alternatively about 5.8 inches, alternatively about 5.81 inches, or alternatively about 5.817 inches, and extends inward by a distance 260 of about 0.5 inches to about 1 inch, alternatively about 0.6 inches, alternatively about 0.62 inches, or alternatively about 0.625 inches. The diameter of the flow connector outlet spaces 208, 208', and 208" near the channels 236, 236', and 236" is about 5 inches, alternatively about 5.1 inches, or alternatively about 5.12 inches, and may decrease slightly toward the flow connector outlet collars 250, 250', and 250" to about 5 inches. In alternative embodiments, however, a flow connector outlet space may have a smaller or larger diameter, for example, a flow connector outlet space adjacent the flow connector outlet collars may be sized at about 4 inches in diameter. In such embodiments, the flow connector having flow connector outlet space sized at about 4 inches in diameter may be connected to a wellhead using no flow reducer 130.

As shown in FIG. 6, the flow connector outlets 245, 245', and 245" are secured to the dome body 225 by weld bead rings 244, 244', and 244", respectively, that are deposited along the perimeters of the flow connector outlet exterior surfaces 248, 248', and 248" adjacent the dome body exterior surface 230. The weld bead rings 244, 244', and 244" substantially form a groove weld extending through the thickness of the flow connector outlets 245, 245', and 245". The inner diameters of the weld bead rings 244, 244', and 244" are about 5 inches, alternatively about 5.1 inches, or alternatively about 5.12 inches, and are configured to match the junctions between the channels 236, 236', and 236", and the flow connector outlet spaces 208, 208', and 208". The weld bead rings 244, 244', and 244" are welded onto the junctions between the channels 236, 236', and 236" and the flow connector outlet spaces 208, 208', and 208". It will be appreciated that having a localized diameter near the weld bead rings 244, 244', and 244" that is slightly larger than the nominal diameters of the connector outlet spaces 208, 208', and 208" and the nominal diameters of the channels 236, 236', and 236" may reduce erosion that may occur near those junctions. For example, the above-described nominal diameters of about 5 inches may be joined by an increased diameter section 231 having a diameter of about 5.1 or alternatively about 5.12 inches. The section 231 may extend a length 233 of about 1 inch along the channel axes 210, 210', and 210". In some embodiments, the increased diameter may be achieved by grinding and the section 231 may be joined to the outlet spaces 208, 208', and 208" with smooth transitions having a radius of curvature of about 0.03-0.09 inches or alternatively about 0.06 inches.

Figure 7:
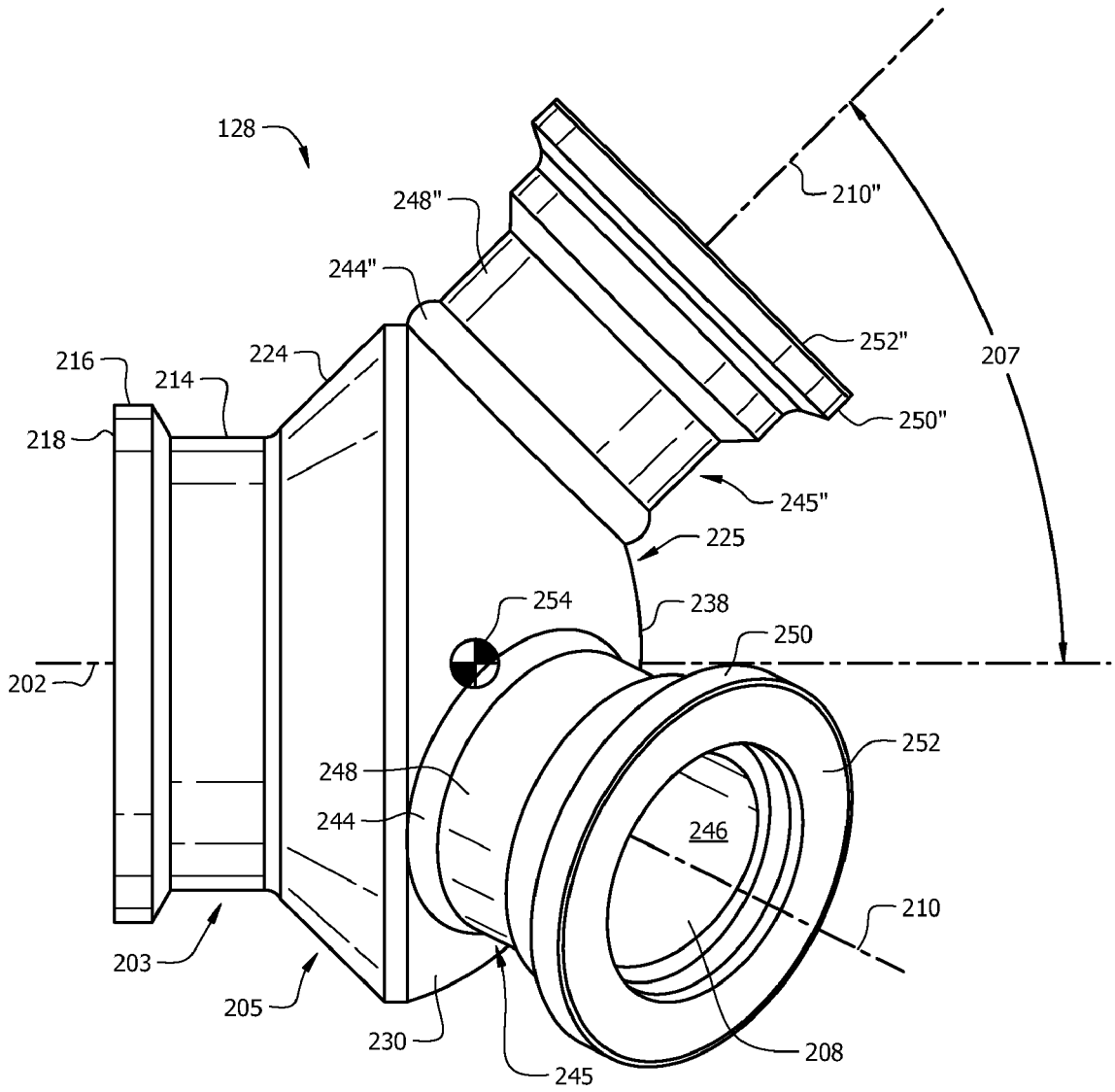
FIG. 7 is another orthogonal view of the flow connector of FIG. 1.

After welding the flow connector outlets 245, 245', and 245" onto the dome body 225, a fully assembled flow connector center of gravity 254 of the flow connector 128 is located on the flow connector central axis 202 and offset from a plane defined by the flow connector flat end face 218 by about 7 inches, alternatively about 7.9 inches, or alternatively about 7.97 inches. An orthogonal view of the flow connector 128 showing the fully assembled flow connector center gravity 254 is shown in FIG. 7.

The flow connector 128 is resistant to erosion when used in a wellbore servicing operation. In such an embodiment, the flow connector 128 has a life expectancy longer than the life expectancy of the conventional connector having outlets orthogonal to its inlet, as described previously and shown in Prior Art FIG. 15. Generally, the conventional connector has an undesirably short life expectancy. Such failure typically occurs near the welded joints between the body and the outlets of the conventional connector. Comparatively, when a flow connector of the type disclosed herein, such as the flow connector 128, is used in a wellbore servicing operation under similar operating conditions to the conditions under which a conventional connector is used, the flow connector 128 exhibits a longer life expectancy. A flow connector 128 last about 1.5, 2, 3, 4, 5, 6, or even more times the life expectancy of a conventional connector. For example, in some wellbore servicing operations where a conventional connector has a life expectancy of about 2 weeks, the flow connector 128 may have a life expectancy of about 3 weeks, 4 weeks, 6 weeks, 8 weeks, 10 weeks, 12 weeks, or even longer. Similarly, the flow connector 128 may exhibit a life expectancy of 150%, 200%, 300%, 400%, 500%, 600%, or even a higher percentage times the life expectancy of the conventional connector. When operated, the life expectancy of the flow connector 128 of the type described herein was improved over the life expectancy of the conventional connector under similar operating conditions.

Figure 11:
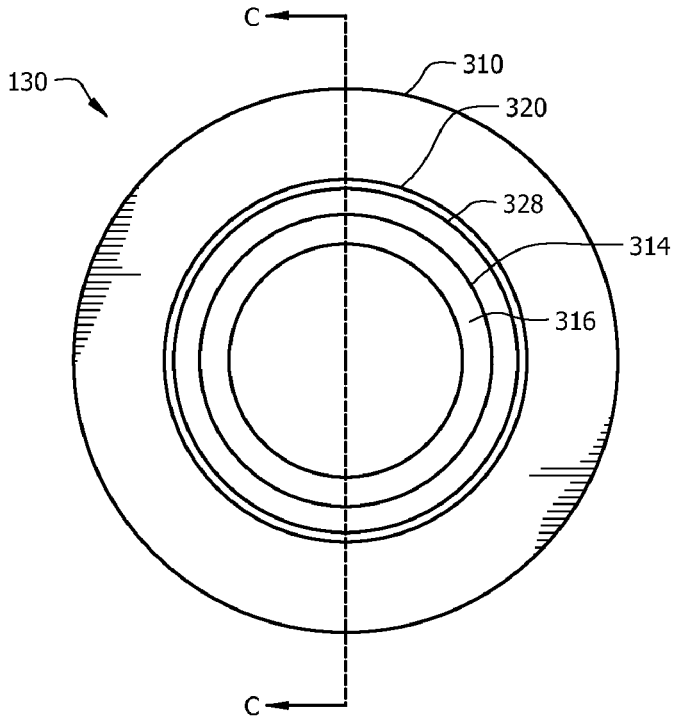
FIG. 11 is an orthogonal view of the flow reducer of FIG. 1.
Figure 12:
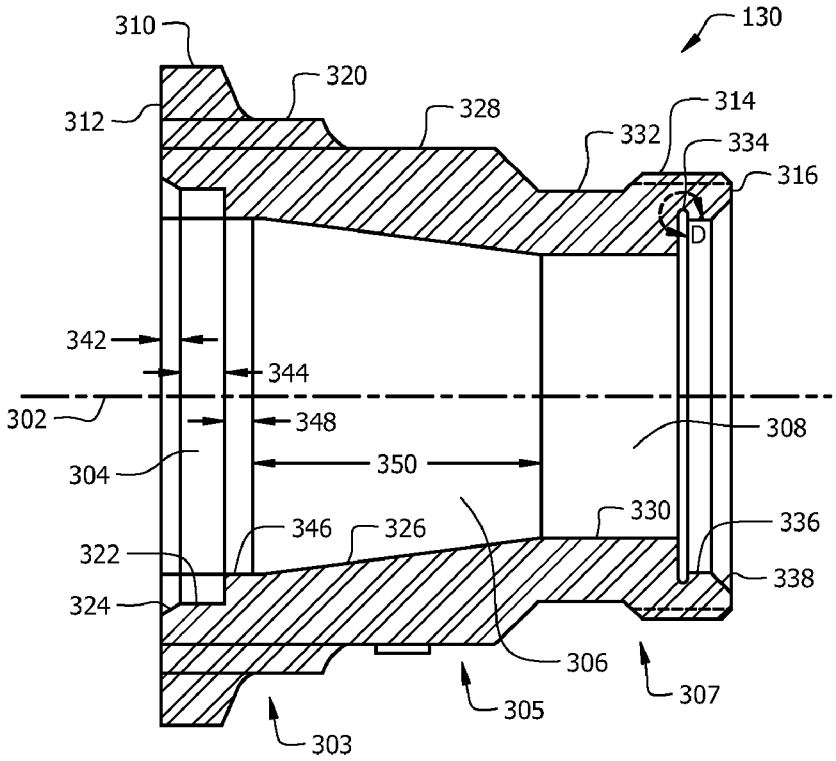
FIG. 12 is a cross-sectional view of the flow reducer of FIG. 1 taken at line C-C of FIG. 11.
Figure 13:
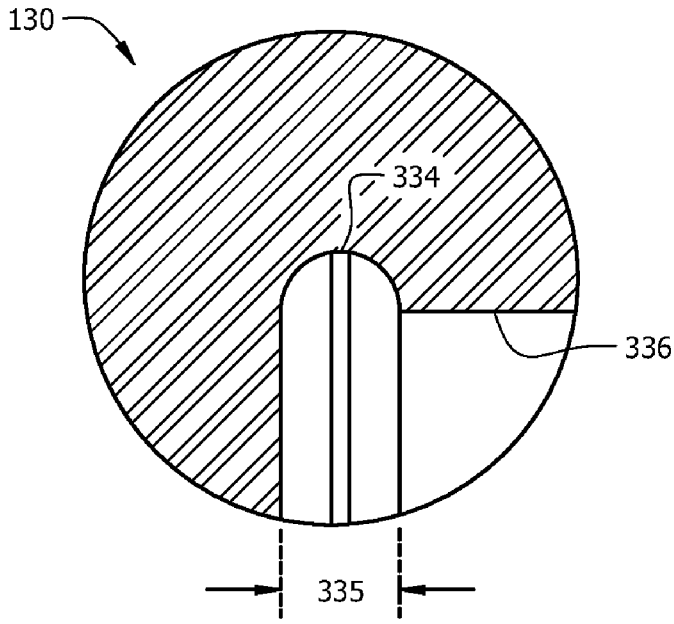
FIG. 13 is a partial cross-00sectional view of the flow reducer of FIG. 1 showing the area within circle D of FIG. 12.
Figure 14:
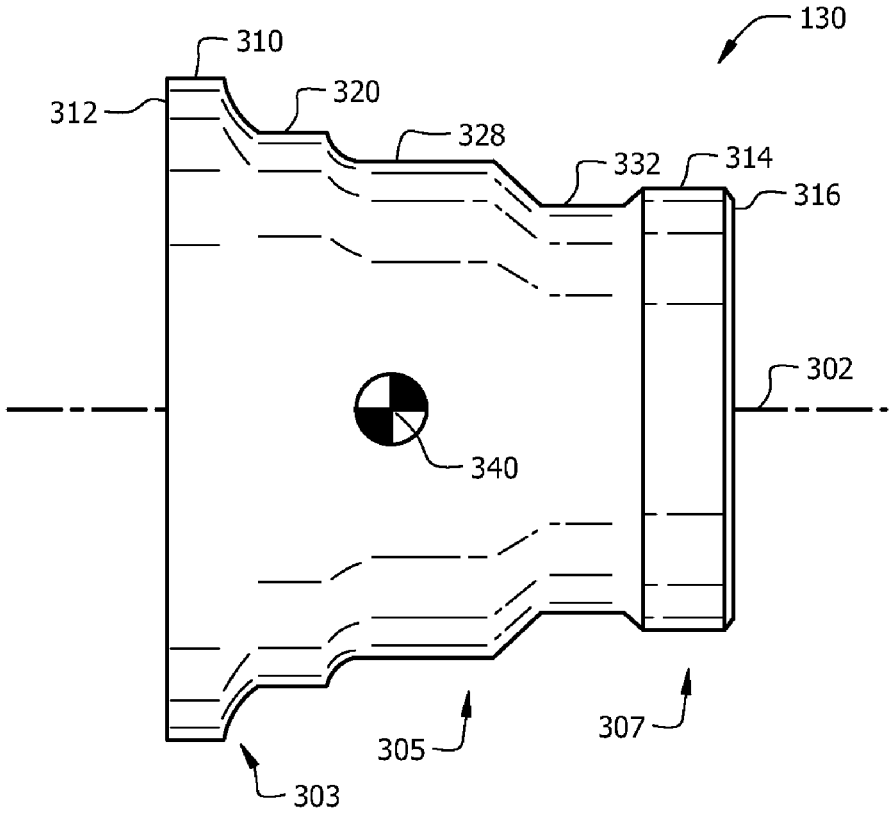
FIG. 14 is a side view of the flow reducer of FIG. 1.

Referring now to FIG. 10, an oblique view of the flow reducer 130 of FIG. 1 is shown. An orthogonal view of the flow reducer 130 is shown in FIG. 11. A cross-sectional view of the flow reducer 130 taken at line C-C of FIG. 11 is shown in FIG. 12. A detail view of the flow reducer 130 showing the area within circle D of FIG. 12 is shown in FIG. 13. A side view of the flow reducer 130 is shown in FIG. 14.

Referring now to FIGS. 10-14, the flow reducer 130 comprises a flow reducer inlet space 304 and a flow reducer central body space 306 adjacent and in fluid communication with the flow reducer inlet space 304. The flow reducer 130 further comprises a flow reducer outlet space 308 adjacent and in fluid communication with the flow reducer central body space 306. As shown in FIG. 12, the flow reducer central body space lies between the flow reducer inlet space 304 and the flow reducer outlet space 308 along the flow reducer central axis 302.

The flow reducer inlet space 304 is defined by a flow reducer inlet 303. The flow reducer inlet 303 has a flow reducer inlet exterior surface 320, a flow reducer inlet hub 310, a flow reducer seal surface 322, and a flow reducer inlet tapered inner edge 324. The flow reducer inlet tapered inner edge 324 extends a distance 342 of about 0.1-0.3 inches, alternatively about 0.2 inches, or alternatively about 0.25 inches, inward along the flow reducer central axis 302. The flow reducer inlet groove 322 has a diameter of about 5 inches, alternatively about 5.7 inches, or alternatively about 5.75 inches and extends a distance 344 of about 0.5-1 inches, alternatively about 0.6 inches, alternatively about 0.62 inches, or alternatively about 0.625 inches, from the tapered inner edge 324 inward along the flow reducer central axis 302. A reduced section 346 has a diameter of about 5 inches and extends from the flow reducer inlet groove 322 a distance 348 of about 0.2-0.4 inches, alternatively about 0.3 inches, alternatively about 0.37 inches, alternatively about 0.375 inches, inward along the flow reducer central axis 302. In this embodiment, the flow reducer inlet 303 has a Big Inch® clamp style interface to accommodate the flow connector outlets 245, 245', and 245" of the flow connector 128 that have Big Inch® clamp style interfaces. The flow reducer inlet collar 310 has an annular shape and comprises a flow reducer inlet flat end face 312 that is perpendicular to the flow reducer central axis 302. The flow reducer inlet groove 322 is configured to receive a seal.

The flow reducer central body space 306 is defined by a flow reducer central body 305. The central body 305 has a flow reducer body interior surface 326 that is frusto-conical in shape and a flow reducer body exterior surface 328 that is cylindrical in shape. The flow reducer body interior surface 326 has an inlet diameter of about 5 inches adjacent the flow reducer inlet space 304 and an outlet diameter of about 4 inches adjacent the flow reducer outlet space 308. The transition from the inlet diameter to the outlet diameter of the flow reducer body interior surface 326 linearly takes place over a distance 350 of about 4 inches, alternatively about 4.0 inches, alternatively about 4.07 inches along the flow reducer central axis 302.

The flow reducer outlet space 308 is defined by a flow reducer outlet 307 having a flow reducer outlet interior surface 330, a flow reducer outlet exterior surface 332, a flow reducer outlet collar 314, a torroidal flow reducer outlet groove 334, a flow reducer outlet groove 336, and a flow reducer outlet inner edge 338. The flow reducer outlet collar 314 has an annular shape and comprises a flow reducer outlet flat end face 316 that is perpendicular to the flow reducer central axis 302. The flow reducer outlet space 308 is adjacent the flow reducer central body space 306, is substantially cylindrical, has an inner diameter of about 4 inches, and extends about 1-2 inches, alternatively about 1.9 inches, alternatively about 1.92 inches, or alternatively about 1.928 inches, along the flow reducer central axis 302. In this embodiment, the flow reducer outlet collar 314 may be threaded to enable a threaded connection to downstream flowlines that ultimately connect to the wellhead 132 of FIG. 1.

FIG. 13 illustrates the flow reducer outlet torroidal groove 334 in greater detail. Generally, the groove 334 has a diameter of about 5 inches, alternatively about 5.1 inches, alternatively about 5.13 inches, alternatively about 5.134 inches. The groove 334 has a length 335 of about 0.1-0.2 inches, alternatively about 0.1 inches, alternatively about 0.15 inches, along the flow reducer central axis 302.

Referring now to FIG. 14, the flow reducer 130 is manufactured as one piece having a length along the flow reducer central axis of about 8 inches. The flow reducer 130 has a flow reducer center of gravity 340 located axially on the flow reducer central axis 302 and offset from a plane defined by the flow reducer flat end face 312 by about 3 inches, alternatively about 3.1 inches, or alternatively about 3.16 inches.

A flow reducer 130 of the type described herein may be used in combination with the flow connector 128 to further improve the life expectancy of the flow connector 128. More specifically, the reducer 130 may be used in conjunction with the flow connector 128 in a wellbore servicing system in a manner that causes failure of the reducer 130 before failure of the flow connector 128 when the reducer 130 and flow connector 128 are subjected to substantially the same conditions for substantially the same amount of time. In an embodiment, a flow reducer 130 may be joined to the flow connector 128 by substantially aligning the flow reducer central axis 302 with a channel axis 210 and substantially mating the flow reducer inlet flat end face 312 with a flow connector outlet flat end face 252. Once mated together, a Big Inch® style clamp may be applied to retain the flow reducer inlet collar 310 and the flow connector outlet collar 250.

The flow connector 128 and/or flow reducer 130 disclosed herein can be used for any purpose. In an embodiment, the flow connector 128 and/or flow reducer 130 disclosed herein are used to service a wellbore that penetrates a subterranean formation. It is to be understood that "subterranean formation" encompasses both areas below exposed earth and areas below earth covered by water such as ocean or fresh water. Servicing a wellbore includes, without limitation, positioning the wellbore servicing composition in the wellbore to isolate the subterranean formation from a portion of the wellbore; to support a conduit in the wellbore; to plug a void or crack in the conduit; to plug a void or crack in a cement sheath disposed in an annulus of the wellbore; to plug a perforation; to plug an opening between the cement sheath and the conduit; to prevent the loss of aqueous or nonaqueous drilling fluids into loss circulation zones such as a void, vugular zone, or fracture; to plug a well for abandonment purposes; to divert treatment fluids; and to seal an annulus between the wellbore and an expandable pipe or pipe string. In another embodiment, the flow connector 128 and/or flow reducer 130 may be employed in well completion operations such as primary and secondary cementing operation to isolate the subterranean formation from a different portion of the wellbore.

In an embodiment, a flow connector 128 and/or flow reducer 130 of the type described herein can be used in a wellbore servicing system 100 for servicing a wellbore. The wellbore servicing system 100 may pump an abrasive fluid down the wellbore to cut at least one component of the wellbore. For example, a casing of the wellbore may be cut and perforation tunnels within a subterranean formation may be created. By using the flow connector and/or the flow reducer of the type described herein, wellbore servicing operations that make use of abrasive mixtures may be accomplished downhole while providing a long lasting flow connector.

Examples

Figure 8:
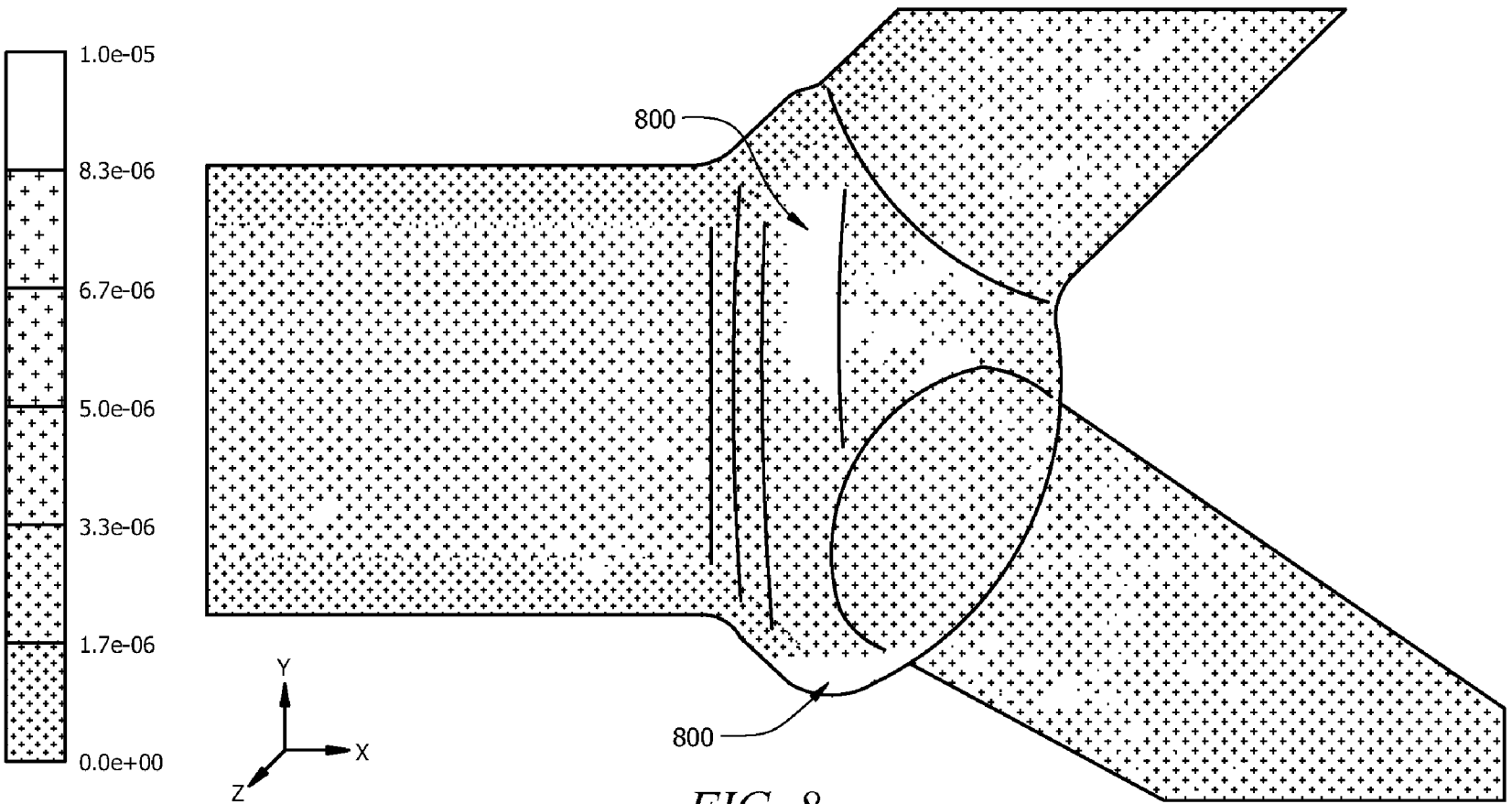
FIG. 8 is a three dimensional contour plot of erosion rate of the flow connector of FIG. 1.

A FLULNT 6.3 flow modeling software was used to investigate the erosion rate of the flow connector 128. The simulation result for the flow connector 128 is shown in FIG. 8, which is a three dimensional contour plot of erosion rate. The simulation parameters (also referred to as boundary conditions) comprised: a total slurry volumetric flowrate of 100 BPM, sand concentration of 2 lb/gal, base fluid density of 8.33 lb/gal, proppant density of 22.7 lb/gal, and an internal diameter of a discharge pipe (that supplied the slurry to the flow connector) of 7 inches. The areas of highest concentration of high erosion rate on the flow connector 128 are on the flow connector body of the flow connector 128 substantially adjacent to surfaces 800 defined between the flow connector central body space 206 and the dome body space 226, as shown in FIG. 8. Surfaces 800 are analogous generally to surfaces in the vicinity of convex joint 232, flow connector central body 205, concave joint 234, and dome body 225 of the flow connector 128. As depicted and discussed above, the flow connector 128 is one embodiment of a flow connector that has been optimized to resist erosion using FLUENT 6.3 flow modeling software, which will be described infra. In alternative embodiments, however, persons of ordinary skill in the art with the aid of this disclosure will appreciate that alternative flow modeling software may be used and the parameters of a flow connector may be slightly modified while still splitting a single flow into multiple flows and exhibiting increased erosion resistance.

Figure 9:
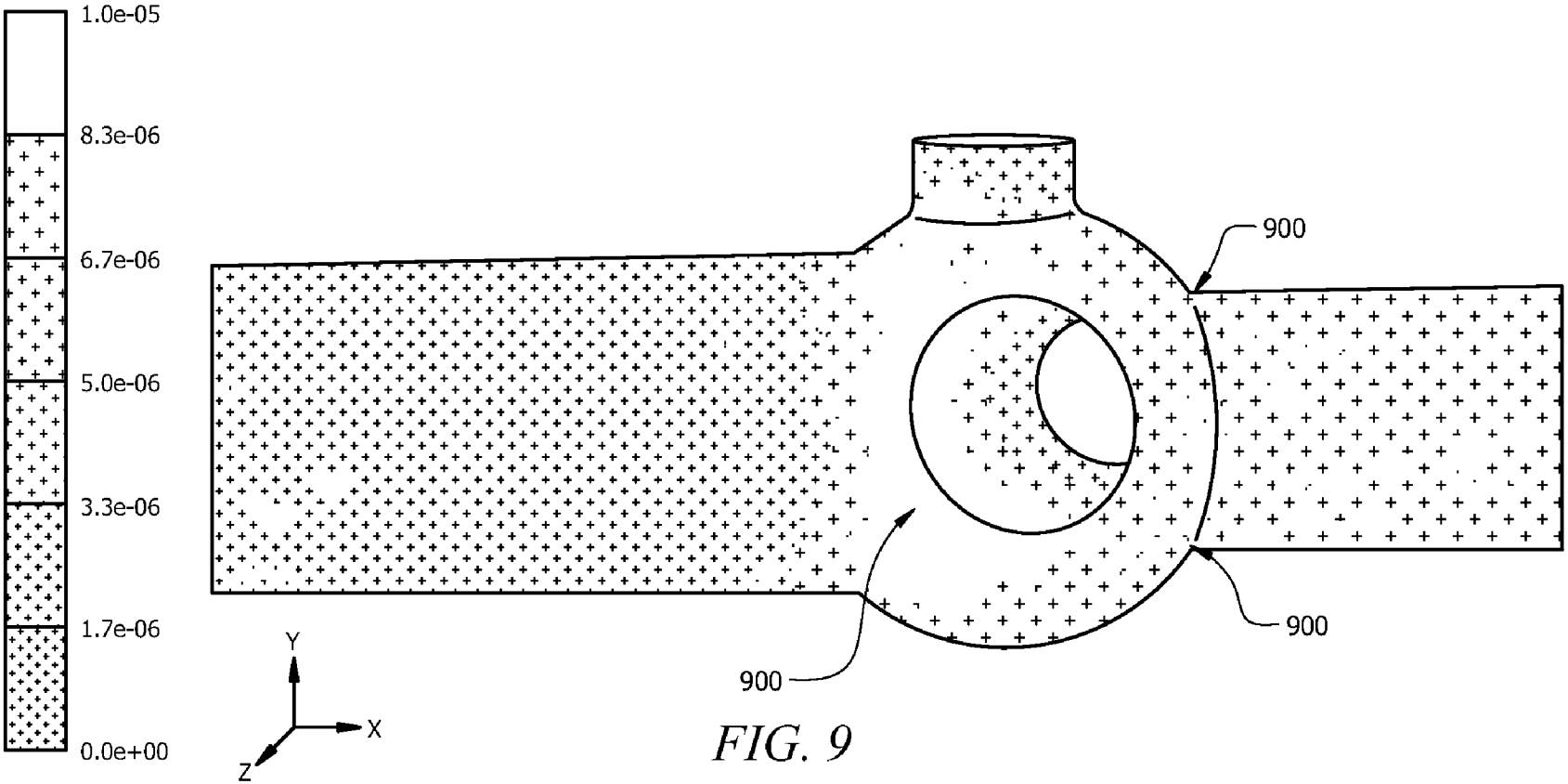
FIG. 9 is a three dimensional contour plot of erosion rate of a conventional connector.

A similar erosion rate simulation was also carried out on the previously discussed conventional connector using substantially similar simulation parameters. The simulation results for the conventional connector are shown in FIG. 9. As depicted, the areas of highest concentration of high erosion rate on the conventional connector are near weld bead rings (900) that orthogonally join the body and the outlets of the conventional connector as shown in FIG. 9. Without wishing to be limited by theory, high concentrations of high erosion rate near weld bead rings may lead to failure since weld bead rings are not as resistant to erosion as compared to a unitary and smooth body portion 800 of flow connector 128. Further, high concentrations of high erosion rate near weld bead rings may exist due to the orthogonal orientation between the inlet and the outlets of the conventional connector. In addition, when comparing FIGS. 8 and 9, the erosion at the weld interfaces of the simulated connector 128 of FIG. 8 occurs at an erosion rate that is about 84% lower than the erosion rate that occurs at the weld interfaces of the simulated conventional connector of FIG. 9.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure.

What is claimed is:

1. A wellbore servicing apparatus, comprising:

an inlet space;

a central space adjacent and in fluid communication with the inlet space along a central axis;

a substantially convex joint connecting the inlet space and the central space;

a dome space adjacent and in fluid communication with the central space along the central axis; and a plurality of channels adjacent to and in fluid communication with the dome space;

wherein the plurality of channels are radially spaced about the central axis; and wherein a channel axis of the at least one of the plurality of channels is incident the central axis by less than ninety degrees.

2. The wellbore servicing apparatus of claim 1, wherein the plurality of channels are substantially evenly radially spaced about the central axis.

3. The wellbore servicing apparatus of claim 1, wherein each of the plurality of channel axes is incident the central axis by substantially the same angle.

4. The wellbore servicing apparatus of claim 1, wherein the plurality of channels are substantially evenly radially spaced about the central axis and wherein each of the plurality of channel axes is incident the central axis by substantially the same angle.

5. The wellbore servicing apparatus of claim 1, wherein the dome space is at least partially defined by a substantially spherical surface.

6. The wellbore servicing apparatus of claim 1, wherein the central space is at least partially defined by a substantially frusto-conical surface.

7. The wellbore servicing apparatus of claim 6, wherein the frusto-conical surface has a taper angle of about forty-five degrees.

8. The wellbore servicing apparatus of claim 1, further comprising:

a substantially concave joint connecting the central space and the dome space.

9. The wellbore servicing apparatus of claim 1, wherein the dome space has a spherical center substantially located on the central axis and between the inlet space and the dome space.

10. The wellbore servicing apparatus of claim 1, further comprising:

a plurality of outlet spaces, each of the plurality of outlet spaces being associated with one of the plurality of channels, and each of the plurality of outlet spaces being adjacent to and in fluid communication with the respective associated channel.

11. The wellbore servicing apparatus of claim 10, wherein each of the plurality of outlet spaces is at least partially defined by a substantially cylindrical surface.

12. The wellbore servicing apparatus of claim 1, further comprising a flow reducer coupled to an outlet space of the plurality of outlet spaces.

13. A method of servicing a wellbore, comprising:

providing a wellbore servicing fluid;

pumping the wellbore servicing fluid to a wellbore services manifold trailer;

transferring at least some of the wellbore servicing fluid from the wellbore services manifold trailer into a central space of a flow connector through an inlet space of the flow connector, wherein a substantially convex joint connects the inlet space and the central space;

transferring at least some of the wellbore servicing fluid from the central space of the flow connector into at least one channel of the flow connector, where the at least one channel has a central axis that is incident a central axis of the inlet space by less than ninety degrees; and transferring the at least some of the wellbore servicing fluid through a dome space of the flow connector prior to passing the at least some of the wellbore servicing fluid through the at least one channel.

14. The method of claim 13, further comprising:

transferring at least some of the wellbore servicing fluid through a plurality of channels, wherein the central axes of the plurality of channels have substantially the same angle of incidence with the central axis of the inlet space.

15. The method of claim 13, further comprising:

transferring at least some of the wellbore servicing fluid from the at least one channel to a wellbore.

16. The method of claim 13, further comprising:

transferring at least some of the wellbore servicing fluid from the at least one channel through a reducer; and transferring at least some of the wellbore servicing fluid from the reducer to a wellbore.

17. The method of claim 13, wherein the wellbore servicing fluid is a particle laden fluid.

18. The method of claim 17, wherein the particle laden fluid is configured to erode an object located within a wellbore.

19. The method of claim 17, wherein the particle laden fluid is configured to erode a portion of a hydrocarbon formation.

20. The method of claim 13, wherein the dome space is at least partially defined by a substantially spherical surface.

* * * * *